United States Patent [19]

Barrus et al.

[11] 4,280,404

[45] Jul. 28, 1981

[54] PRINTER HAVING VARIABLE HAMMER RELEASE DRIVE

[75] Inventors: Gordon B. Barrus, El Segundo; Jerry Matula, Westminster, both of Calif.

[73] Assignee: Printronix, Inc., Irvine, Calif.

[21] Appl. No.: 81,559

[22] Filed: Oct. 3, 1979

[51] Int. Cl.[3] ..... B41J 7/92

[52] U.S. Cl. ..... 101/93.03; 101/93.04; 101/93.29; 400/157.3

[58] Field of Search ..... 101/93.03, 93.04, 93.05, 101/93.29–93.34, 93.48; 400/124, 157.3, 166

[56] References Cited

U.S. PATENT DOCUMENTS

| | | | |
|---|---|---|---|
| 3,941,051 | 3/1976 | Barrus et al. | 101/93.04 |
| 4,027,761 | 6/1977 | Quaif | 101/93.03 X |
| 4,044,668 | 8/1977 | Barrus et al. | 101/93.04 |
| 4,103,617 | 8/1978 | O'Brien et al. | 101/93.03 |
| 4,189,997 | 2/1980 | Nozaki et al. | 101/93.29 X |

OTHER PUBLICATIONS

Mills et al., IBM Tech. Discl. Bulletin, vol. 15, No. 8, Jan. 1973, p. 2356.

Sweat, IBM Tech. Discl. Bulletin, vol. 22, No. 5, Oct. 1979, pp. 1756–1758.

Ackerman, IBM Tech. Discl. Bulletin, vol. 22, No. 4, Sep. 1979, pp. 1540–1541.

*Primary Examiner*—Edward M. Coven

*Attorney, Agent, or Firm*—Fraser and Bogucki

[57] ABSTRACT

In a dot matrix line printer in which selected ones of a plurality of hammers mounted on a reciprocating hammer bank are released in response to successive sets of serial data to print dots on a paper, the changing hammer release characteristics which are caused by different numbers of hammers being released with each new set of serial data are compensated for by an arrangement providing a varying hammer release signal in accordance with the number of hammers being released. The variable release signal is provided in the form of a variation in the time interval during which the drive amplifiers associated with hammer release coils are turned on, thereby effectively varying the length of a current pulse provided to each coil in direct proportion to the number of hammers to be released. A counter is preset, then counted down from the preset value in accordance with the number of hammers to be released as represented by a set of serial data being provided to a shift register. When the shift register is loaded, latches associated with the various stages of the shift register containing hammer release signals are set so as to turn on associated ones of the drive amplifiers. The counter counts up in response to clock pulses until it overflows and clears the latches so as to turn off the drive amplifiers.

8 Claims, 10 Drawing Figures

PRINTER HAVING VARIABLE HAMMER RELEASE DRIVE

BACKGROUND OF THE INVENTION

1. Field of the Invention

The present invention relates to printers, and more particularly to dot matrix line printers in which individual hammers of a reciprocating hammer bank are selectively released to print characters and other information on a paper or other printable medium in dot matrix fashion.

2. History of the Prior Art

Line printers in which a hammer bank is reciprocated relative to a paper or other printable medium with hammers mounted along the length of the hammer bank being selectively actuated to impact the paper and thereby effect printing in dot matrix fashion are well known as shown, for example, by U.S. Pat. No. 3,941,051 of Barrus et al. In the Barrus et al patent which is commonly assigned with the present application, a plurality of elongated, thin, flat hammer springs are mounted in generally parallel, spaced-apart relation at a first end of each spring along the length of an elongated hammer bank structure. Dot impacting elements are mounted adjacent the opposite second ends of the hammer springs. Magnetic circuits between the opposite first and second ends of each hammer spring are completed by a permanent magnet and associated magnetic return path member of elongated configuration which are common to all of the hammers. The magnetic return path member mounts a plurality of pole pieces along a portion thereof opposite the permanent magnet. Each pole piece extends into contact with the upper second end of a different one of the hammer springs and is provided with a hammer release coil.

Each hammer spring is normally held in a retracted position by action of the permanent magnet. The force of the permanent magnet may be temporarily overcome so as to release the hammer spring by momentary energization of the coil mounted on the associated pole piece. This allows the hammer spring to fly into a neutral position where the hammer has attained maximum kinetic energy. At this point the dot imprinting tip mounted thereon impacts the paper and an included ink ribbon to print a dot. Upon impacting of the paper and ribbon, the hammer spring rebounds from the paper and ribbon and moves back to the retracted position in which it resides against the associated pole piece under the influence of the permanent magnet.

Arrangements of the type shown in the previously referred Barrus et al patent are capable of precise, on-the-fly printing so as to be capable of printing at speeds well in excess of 300 lines per minute where each line can require as many as 10 separate sweeps of the hammer bank and can contain as many as 132 characters, each of which is 5 dot columns wide. To print in this fashion release of the hammer springs must be precisely controlled. A sufficient amount of current must be provided to each coil over a proper time interval so as to allow the hammer to release, impact the paper with a desired amount of force and then rebound into the retracted position in a rapid and efficient manner in preparation for the next dot position. Once these precise operating conditions are established they must be maintained to provide uniformity in printing.

One problem which results in nonuniform hammer release characteristics and therefore nonuniform printing relates to the changing magnetic characteristics of the hammer bank as different numbers of the hammers are released. The use of certain common components in the hammer bank including the permanent magnet and the magnetic return path member as well as the relatively close proximity of the hammer springs to one another results in changes in such things as the reluctance of the magnetic path as the number of hammers being released changes. The result is that when a relatively large number of hammers are released, each release tends to be relatively slow or less than fully complete, resulting in the hammer spring flying into the print position with less than the desired velocity and kinetic energy. The result is that impacting may not be hard enough to maintain the desired dot density. Also, the retraction of the hammer spring may be difficult to accomplish, particularly in the short amount of time required to ready the hammer bank for the next dot position across the print paper. The problem is aggravated with the design of new hammer banks in which the number of hammers may be increased and the hammers themselves may be placed closer together and designed to undergo a shorter stroke in order to accomplish even higher printing speeds. Such factors result in even greater nonuniformity of operation depending upon the number of hammers released at each dot position.

Nonuniform hammer release characteristics can result from other factors in addition to variations in the number of hammers released. One such common factor is variations in the power supply. Such variations can ultimately affect the amplitude of current applied to the hammer release coils and thereby the timing and force of hammer release as the hammer bank moves to successive dot positions.

Accordingly, it is an object of the present invention to provide an improved hammer bank arrangement in a dot matrix line printer.

It is a further object of the invention to provide a printer hammer bank arrangement which provides for generally uniform release characteristics despite variations in operating parameters of the hammer bank arrangement.

It is a further object of the invention to provide a printer hammer bank arrangement which substantially reduces or minimizes nonuniformities in the hammer release characteristics which can occur as different numbers of hammers are released.

BRIEF SUMMARY OF THE INVENTION

The above-noted objects are accomplished in accordance with the invention by a hammer bank arrangement in which signals applied to release the hammers are varied in direct relation to a varying parameter such as the number of hammers in the bank being released. It has been found in accordance with the invention that substantial uniformity can be maintained by energizing the coils which effect hammer release in one particular embodiment during a time period made directly proportional to the number of hammers being released. The increased duration of release energization compensates for the significant changes in magnetic properties of the hammer bank as relatively large numbers of hammers are released simultaneously. Nonuniformities due to variations in power supply voltage can be minimized by varying the duration of hammer release energizing action in direct relation to the power supply voltage.

In a preferred embodiment of a hammer bank arrangement according to the invention which compensates for constant changes in the number of hammers released, each hammer is provided with a release coil coupled to a different one of a plurality of driver amplifiers. The driver amplifiers are coupled to be turned on or off by associated latches coupled to the different stages of a shift register which receives the serial data to be printed. The serial data comprises a succession of bits denoting whether the successive hammers along the bank are to be released or not. Those bits denoting a hammer release cause the associated latch to be set upon application of a set signal to the bank of latches. When a latch is set, it turns on the associated driver amplifier to provide current to the included hammer release coil. The current to the release coil is terminated with the clearing of all latches in the bank of latches.

The time interval between the setting of selected latches and the clearing of all latches is varied in direct relation to the number of hammers to be released as determined from the serial input data. A counter is preset to a selected count value, and is then counted down by each bit of the serial input data denoting release of a hammer. In this manner the counter is counted down from the preset value by an additional value representing the number of hammers to be released. When the latches coupled to stages of the shift register containing hammer release bits are set so as to commence energization of the associated hammer release coils, the counter begins to count up in response to clock pulses. When the counter reaches a predetermined value represented by overflow of the counter, the latches are cleared so as to terminate application of current to the hammer release coils. The preset value within the counter differs from the overflow value by an amount necessary to properly energize the release coil in the case where only one hammer in the bank is being released. Thus, each downward count beyond the preset count value extends the application of release current by the additional amount needed to compensate for the release of one more hammer in the bank.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
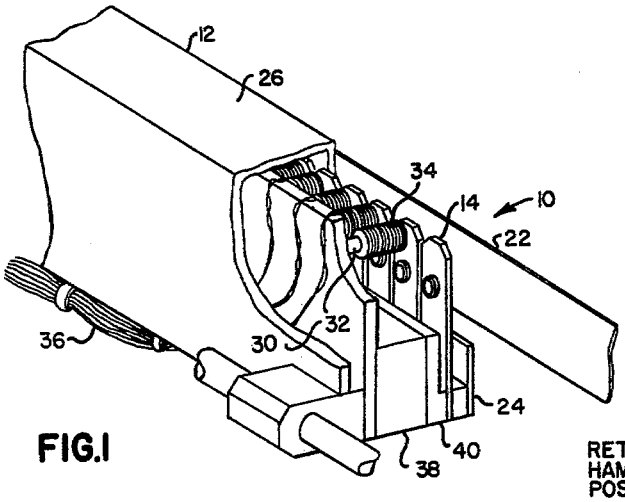
FIG. 1 is a perspective view, partly broken away, of a hammer bank which may be used in accordance with the invention.
Figure 2:
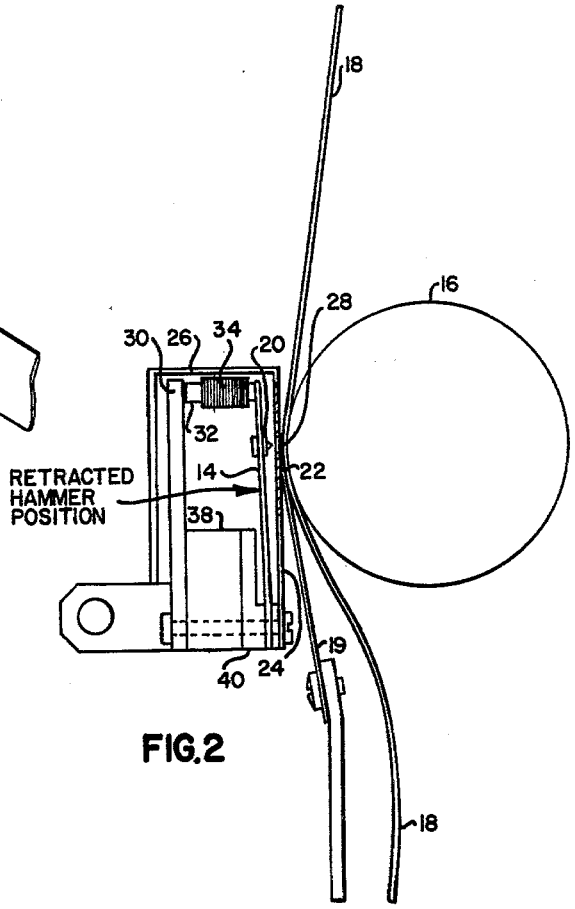
FIG. 2 is a side sectional view of the hammer bank of FIG. 1.

A hammer bank arrangement 10 in accordance with the invention is illustrated in FIGS. 1 and 2. The hammer bank arrangement 10 includes a hammer bank 12 similar to the hammer bank described in the previously referred to patent of Barrus et al.

The hammer bank 12 includes a plurality of hammers 14 mounted in generally parallel, spaced-apart relation along the length of the hammer bank 12. The hammers 14 are elongated, resilient magnetic spring elements mounted at a lower fixed end along a horizontal axis of the hammer bank 12, with each of the hammers being vertically disposed and terminating in a movable free second end. Each of the hammers 14 lies approximately tangential to a platen 16 disposed on the opposite side of a paper 18 or similar printable medium and providing a backing support for receiving the impact of the hammers 14. The paper 18 is held against the platen 16 by a plurality of spring fingers 19. Each hammer 14 includes a dot matrix printing tip 20 mounted adjacent the upper second end of the hammer and extending normal from the surface of the hammer in the direction toward the paper 18 and an adjacent ribbon 22.

The tips 20 of the successive hammers 14 lie along a selected horizontal line substantially radial to the adjacent arc of the curved surface of the platen 16 and defining the printing line position. When retracted, each tip 20 is disposd slightly behind the front face 24 of a shuttle cover 26. When impacting, the tips 20 alone extend through apertures 28 in the front face 24 of the cover 26.

The hammer bank 12 includes a planar common return member 30 mounted in parallel, spaced-apart relation to the hammers 14 on the opposite side from the hammer tips 20 and providing a common magnetic return path for the magnetic circuits of the hammer bank 12. Individual pole pieces 32 are mounted in generally parallel, spaced-apart relation along the top portion of the common return member 30 so as to extend outwardly therefrom and into contact with the upper second ends of the different hammers 14. Each hammer 14 is in contact and in magnetic circuit with the associated pole piece 32 when in the retracted position. Hammer release coils 34 are individually wound around each of the pole pieces 32, with leads from the coils conveniently being joined to terminals and printed circuit conductors on the common return member 30. External conductors to associated circuits are physically coupled together in a harness 36 extending outwardly from the hammer bank 12. The harness 36 reciprocates along its length with the motion of the hammer bank 12. The magnetic circuit in the hammer bank 12 also includes a common permanent magnet 38 of elongated bar form, disposed between the common return member 30 and a magnetic insert 40 which abuts the fixed bottom end of each hammer 14.

The hammer bank 12 operates by individually releasing the spring hammers 14 from a retracted position in which the hammers 14 are held against the pole pieces 32. A closed loop magnetic path is normally defined by the permanent magnet 38, the common return member 30, the pole piece 32, the hammer 14 itself, and the insert 40. When retracted, the hammer is held with the tip 20 out of engagement with the ribbon 22 and is slightly behind the cover front face 24 as previously described. The moving ink ribbon 22 therefore bears against the front face 24 and does not slide with any substantial frictional force against the paper 18. When a given coil 34 is energized, however, the magnetic field in the individual circuit is neutralized adjacent the free end of the associated hammer 14, and the hammer 14 is released. The spring effect of the hammer 14 causes it to fly with a predetermined velocity and flight time to impact the tip 20 against the ribbon 22 and underlying paper 18. The motion and force are both predictable and controllable, inasmuch as they result only from the constant spring characteristics of the hammer 14 and the distance of its flight. Variations in printing intensity may be introduced by varying the time of termination of the energizing pulses, and thus the time of regeneration of the restoring force exerted by the permanent magnetic field. Usually, however, the field cancelling pulse is terminated in coincidence with the impact time. In the present example, the complete cycle time is approximately 670 microseconds. The hammer is therefore ready to cycle again after approximately 670 microseconds, having impacted the paper, returned to the retract position, and settled to a static condition.

The high speed motion of the individual hammers 14 within the hammer bank 12 is effectively employed with the continuous reciprocating motion of the hammer bank 12. The hammer bank 12 is ideally driven with a substantially trapezoidal velocity function using a mechanism such as that shown in the previously referred to patent of Barrus et al. The hammer bank 12 operates at a substantially constant speed, such as 25 inches per second in the case of a 600 line per minute printer, for a given duration in one direction, and changes velocity at a substantially constant rate until it is reciprocated in the opposite direction, again at a substantially constant speed, and so forth. In each of the substantially constant speed motions, successive dots for each of several characters are imprinted serially along the given dot printing positions for that horizontal line of a character.

In conventional printer systems the hammer release coils such as the coils 34 in the hammer bank 12 of FIGS. 1 and 2 are energized by a current pulse of fixed length or duration chosen to provide the individual hammers with optimum operating characteristics. It has been observed that such characteristics vary in accordance with the number of hammers released at a given dot position of the hammer bank 12. Such changes are due to changes in the magnetic characteristics of the hammer bank when different numbers of hammers are released. The larger the number of hammers released, the less is the release force at the individual hammers and vice versa. Thus, when all or substantially all of the hammers of the hammer bank 12 are released at a given dot position the opposing magnetic field provided by energization of the coils 34 may be barely adequate or even inadequate to release the hammers in such a way that they move to the impact position with the desired velocity and impact force. Conversely, if the energizing current pulse to the hammer release coils 34 is chosen to provide optimum release characteristics when far more than just a few of the hammers are released, then another effect will occur when only one or a few hammers are released. In that instance the hammers may be released adequately. However, the hammer release current may continue during impact and part of the rebound, delaying retraction and resulting in the hammer being unprepared for possible release at the next dot position.

The changing hammer release characteristics which occur when different numbers of the hammers in the bank are released may be tolerable or even insignificant in relatively low performance printers and even in the case of printers operating at speeds of 300 lines per minute with a bank of as many as 44 hammers. However, the problem tends to become significantly worse with higher performance printers such as those capable of printing at speeds on the order of 600 lines per minute or more and using greater numbers of hammers such as 66 hammers in a bank. In such instances the changes in release characteristics become much more pronounced due to close placement of a larger number of hammers, producing a larger load change on the common permanent magnet. Changes in release characteristics may also be affected by a shorter and more critical flight path and timing for the hammer printing tip.

Figure 3:
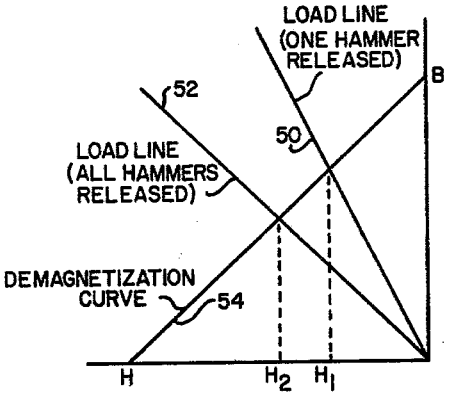
FIG. 3 is a B-H curve illustrating the changing magnetic characteristics with the number of hammers released in the hammer bank of FIG. 1.

FIG. 3 comprises a B-H curve illustrating the substantial variation in the load line of the magnetic characteristics of the hammer bank when large numbers of hammers are used at very high speeds of operation. The curve of FIG. 3 corresponds to the hammer bank 12 of FIGS. 1 and 2 having 66 hammers therein and operating at a speed necessary to print 600 lines per minute. A first line 50 represents the load line when only one hammer is released at a given dot position for the hammer bank. A second line 52 illustrates the load line when all hammers in the hammer bank are simultaneously released at a given dot position. It will be seen that the change in the load line between the line 50 and the line 52 is substantial. A line 54 represents the demagnetization curve of the common permanent magnet 38 when the magnet is made of ceramic material. The intersections of the load line extremes 50 and 52 with the demagnetization curve 54 provide values $H_1$ at the extreme where only one hammer is released and $H_2$ at the other extreme where all hammers are released. It will be seen that $H_1$ and $H_2$ are of substantially different value.

Figure 4:
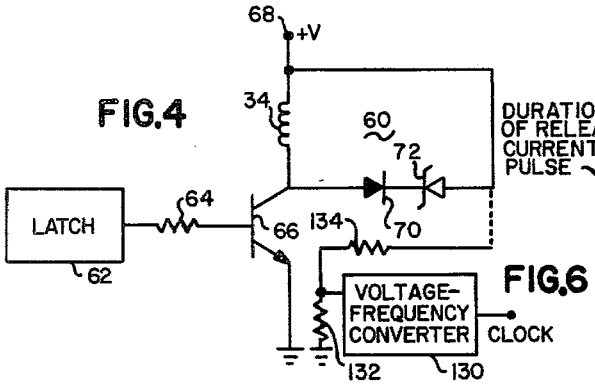
FIG. 4 is a schematic circuit diagram of a hammer driver amplifier and associated latch used in the hammer bank of FIG. 1.

FIG. 4 depicts a typical driver amplifier 60 and an associated latch 62 used to energize one of the hammer release coils 34. When a latch 62 is set indicating that the coil 34 is to be energized, the output of the latch 62 which is coupled through a resistor 64 to the base of a transistor 66 goes high so as to bias the transistor 66 into conduction. The transistor emitter is grounded, and the collector is coupled through the coil 34 to a positive voltage supply terminal 68. The transistor collector is also coupled to the supply terminal 68 through a diode 70 and a Zener diode 72 coupled in series with one another. When the transistor 66 is biased into conduction by the output of the latch 62, the collector voltage drops from +V to ground and remains there until the output of the latch 62 goes low and the current to the base of the transistor 66 is thereby terminated. When the output of the latch 62 goes low and the transistor 66 is thereby biased into non-conduction, the collector voltage rises to a value equal to +V plus the cutoff voltage of the Zener diode 72 and then gradually drops back to the value +V. The collector voltage of the transistor 66 is depicted in FIG. 5C.

Figure 5A:
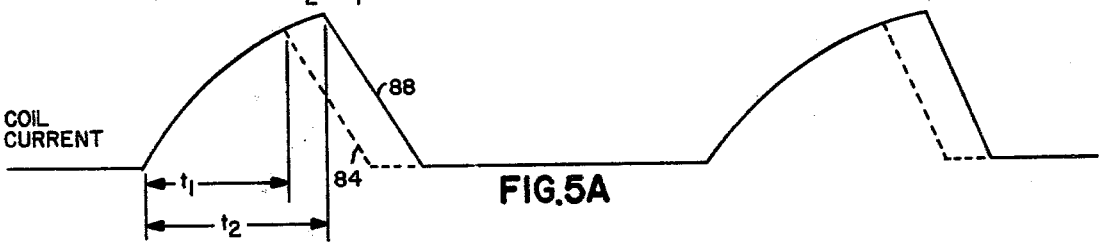
FIG. 5A is a waveform of current applied to the hammer release coil by the circuit of FIG. 4 as a function of time.
Figure 5B:
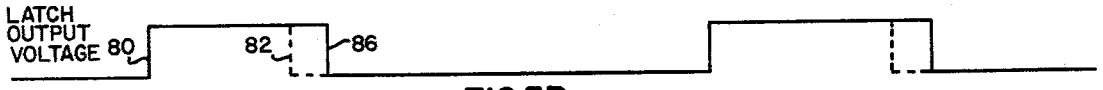
FIG. 5B is a waveform of voltage at the output of the latch of FIG. 4 for producing the coil current of FIG. 5A.
Figure 5C:
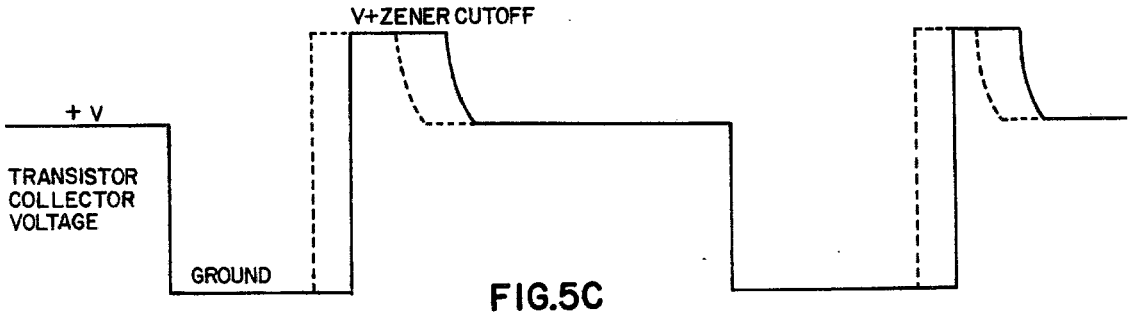
FIG. 5C is a waveform of collector voltage in the hammer driver amplifier of FIG. 4.

FIG. 5A depicts the current through the hammer release coil 34 of FIG. 4 as a function of the voltage at the output of the latch 62 of FIG. 4 which is shown in FIG. 5B. It will be seen that when the output of the latch 62 goes high such as at a point 80 in FIG. 5B the current through the coil 34 begins to rise. If the latch output is allowed to remain high for a period $t_1$, then the latch output drops at a point 82 and the coil current begins to decrease in straight line fashion as illustrated by a dotted line 84. If the latch output is allowed to remain high for a longer interval $t_2$ so as to terminate at a point 86, then the coil current continues to rise beyond the cutoff point 82 at the end of $t_1$ until the point 86 is reached, whereupon the coil current decreases in generally linear fashion as shown by a line 88.

Figure 6:
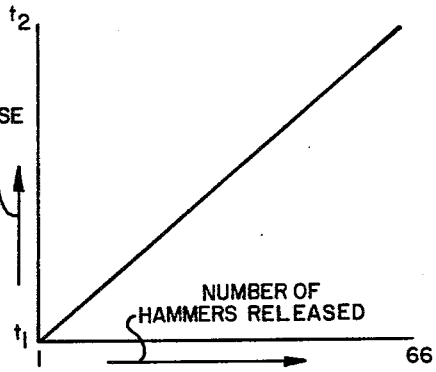
FIG. 6 is a diagrammatic plot illustrating the direct relationship between the number of hammers released and the duration of the release current pulse.

In accordance with the invention it is recognized that the time interval between setting and clearing of the latch 62 directly varies the amount and duration of the current applied to the hammer release coil 34. It is further recognized that uniform hammer release characteristics result in a substantially linear relationship between the number of hammers released and the duration of the current pulse to the hammer release coil as shown in FIG. 6. FIG. 6 is a plot of the release current duration required to provide uniform release characteristics for different numbers of hammers released. $t_1$ represents the minimum time that the latch must be set to release one hammer with the desired release characteristics. At the other extreme, $t_2$ represents the time interval during which the latch must be set to provide a sufficient amount of current to the release coils so that the same desired magnetic characteristics are maintained when all 66 hammers in the hammer bank are simultaneously released.

Figure 7:
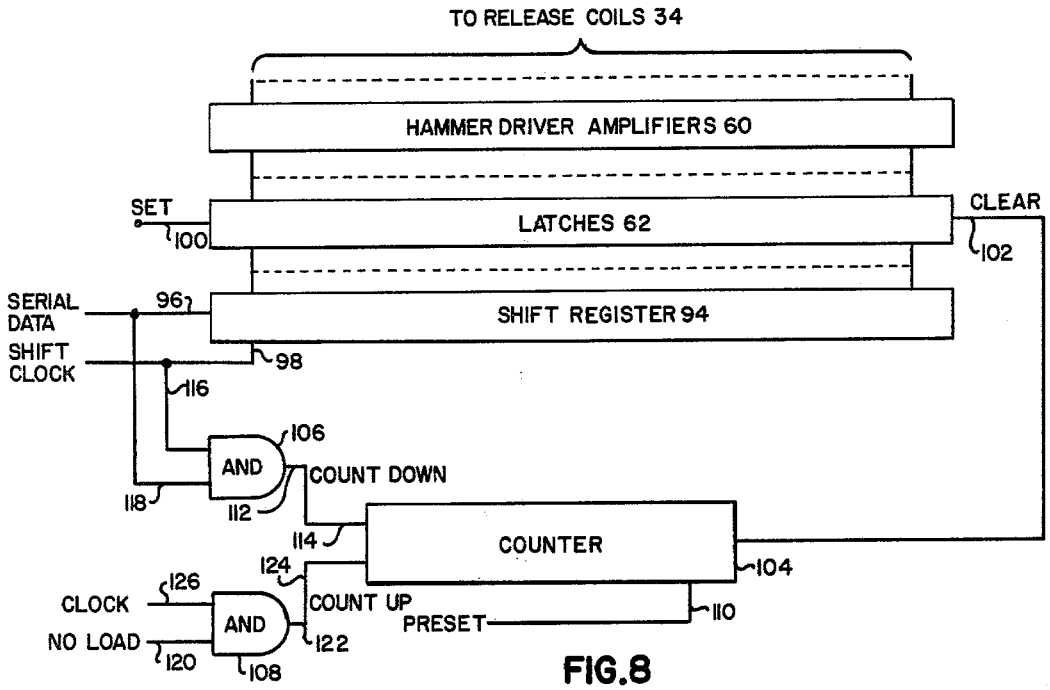
FIG. 7 is a block diagram of a preferred arrangement for varying the duration of the release current pulse as a function of the number of hammers released.

FIG. 7 depicts an example of a circuit for energizing the various hammer release coils 34 of the hammer bank 12 so as to maintain uniform release characteristics. The circuit of FIG. 7 varies the duration of the output current from the latch 62 between $t_1$ and $t_2$ in direct proportion to the number of hammers to be released at a given dot position for the hammer bank 12. The circuit of FIG. 7 does this by examining the serial data for each dot position of the hammer bank to determine the number of hammers to be released and then varying the time interval between setting of the appropriate latches and clearing of the latches in direct relation thereto.

The circuit of FIG. 7 includes a shift register 94 having an input 96 coupled to receive the serial data for each dot position of the hammer bank 12. The serial data comprises a serial string of 66 bits, each of which represents the condition of a different one of the 66 hammers of the hammer bank 12 for a given dot position of the hammer bank. Each bit therefor indicates whether a particular hammer is to be released or not. The bits are serially shifted through 66 different register stages comprising the shift register 94 under the control of a shift clock signal applied to an input 98 of the shift register 94.

Figure 8:
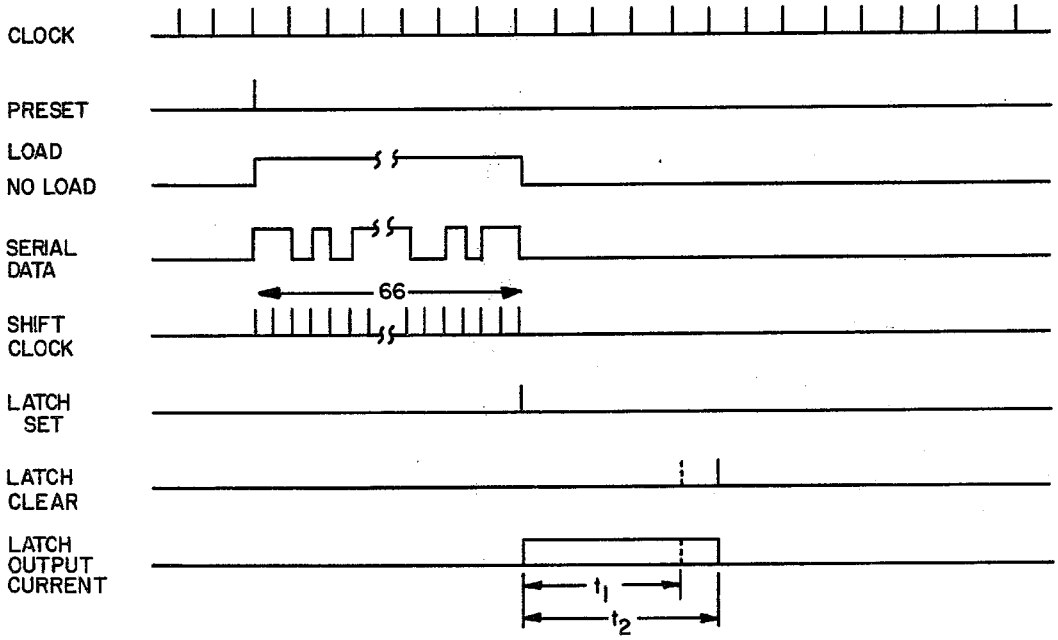
FIG. 8 comprises various waveforms useful in explaining the operation of the circuit of FIG. 7.

The operation of the circuit of FIG. 7 described thus far can be better understood by referring to the corresponding waveforms of FIG. 8. Referring first to the shift clock signal it will be seen that 66 shift clock pulses are provided so as to load the 66 bits of the serial data into the shift register 94. The 66 bits are loaded into the shift register 94 during a load interval in which a load signal also shown in FIG. 8 goes from a no load state to a load state. The serial data is illustrated as comprising a series of short vertical pulses representing those bits denoting hammer release.

When the shift register 94 has been loaded with the serial data, the load interval is terminated. At the same time a set signal shown in FIG. 8 is applied to the latches 62 to set those of the 66 latches which are coupled to a stage of the shift register 94 storing a hammer release bit. The set signal is applied to a set input 100 to the latches 62. Each of the latches 62 which has been set turns on an associated one of the 66 hammer driver amplifiers 60 in the manner previously described in connection with FIG. 4 to commence energization of an associated one of the hammer release coils 34. Energization of release coils 34 continues until the output of each of the set latches goes low upon the application of a clear signal to all of the latches 62 at an input 102. The time interval between setting and clearing of the latches 62 is determined in accordance with the invention by a counter 104 in conjunction with a pair of AND gates 106 and 108. The counter 104 provides a clear signal to the latches 62 when it reaches a predetermined value represented by the overflow condition. At the beginning of the load interval in which the serial data is loaded in the shift register 94, the counter 104 is preset by application of a signal at a preset input 110. The signal at the input 110 effectively counts down the counter 104 to a preset count value differing from the predetermined or overflow condition count value at which the latch clear signal occurs by an amount corresponding to one less than $t_1$. It was previously noted that $t_1$ represents the duration of the latch output current required where one hammer is to be released. After being preset by a pulse as shown in FIG. 8, the counter 104 is counted down further in accordance with the number of hammers to be released. The AND gate 106 has an output 112 coupled to a count down input 114 to the counter 104. The AND gate 106 has a first input 116 coupled to receive the shift clock pulses and a second input 118 coupled to receive the serial data. The shift clock pulses enable the input 116 of the AND gate 106 as each occurs during the load interval. This enables the AND gate 106 to pass each bit from the serial data denoting hammer release to the count down input 114, resulting in the counter 104 counting down by one count upon receipt of each bit denoting hammer release.

When all of the serial data has been loaded into the shift register 94, the shift clock pulses terminate, disabling the AND gate 106. At the same time the load signal drops to the no load state so as to enable a first input 120 of the AND gate 108 which has an output 122 coupled to a count up input 124 to the counter 104. The AND gate 108 has a second input 126 coupled to receive clock pulses which are shown in FIG. 8. With the input 120 of the AND gate 108 enabled by the no load condition, the AND gate 108 passes the clock pulses to count up the counter 104. The counter 104 counts up in response to the clock pulses until it overflows and provides the clear signal to the latches 62. The clock signal which is arbitrarily shown in FIG. 8 as having a frequency equal to one-half that of the shift clock does not bear any particular relationship to the shift clock. Instead, the clock frequency is chosen taking into consideration the range of the counter 104 and the current pulse duration required to achieve $t_1$, $t_2$ and values therebetween.

It will therefore be seen that the counter 104 in conjunction with the AND gates 106 and 108 functions to vary the duration of energizing current to the release coils in direct proportion to the number of hammers being released. The counter 104 is preset to a value which is one count less than the count required to provide $t_1$. The counter is then further incremented, in this particular example in the downward direction, by those bits of the serial data representing a hammer release. The counter is thus counted down to a value representing the current pulse duration required to provide uniform release characteristics for a number of hammers to be released as denoted by the serial data. The desired current pulse duration is thereafter achieved by counting the counter up to the overflow condition.

As previously noted the duration of the hammer release current can be varied in accordance with the invention to compensate for other variables in addition to the changing number of hammers released. For example, the paper 18 can comprise a single ply of paper or in some instances a stack of plies with carbon paper or the like in between. In the latter case it may be desirable to vary the duration of the coil release current to provide the greater impact force required as well as to compensate for the shorter flight path of each hammer between the retracted position and the first ply of the stack of paper plies to be impacted.

For a given number of hammers to be released, the release characteristics can vary with fluctuation in the power supply voltage. This can be corrected in accordance with the invention by lengthening the duration of the hammer release current to compensate for reductions in the supply voltage. FIG. 4 depicts circuitry which can be added to the driver amplifier 60 to implement this. The input of a voltage to frequency converter 130 is coupled to ground via a resister 132 and to the +V supply terminal 68 via a resister 134 so as to monitor variations in the supply voltage +V. The output of the converter 130 which is a frequency varying as a function of the input voltage is used as the clock signal in the circuit of FIG. 7. The circuit of FIG. 7 is modified so that upon being preset, the counter 104 is counted up by the clock signal from the voltage to frequency converter 130. When the counter 104 overflows, the latches 62 are cleared in the manner previously described. It will be seen that as the supply voltage +V increases the clock frequency as provided by the converter 130 increases, thereby shortening the time required for the counter 104 to count up from the preset value to overflow and thus the duration of the hammer release current. Conversely, a decrease in +V reduces the clock frequency so as to lengthen the time required for the counter 104 to count up from the preset value and thus the duration of the hammer release current.

While the invention has been particularly shown and described with reference to a preferred embodiment thereof, it will be understood by those skilled in the art that various changes in form and details may be made therein without departing from the spirit and scope of the invention.

What is claimed is:

1. A hammer bank arrangement for use in a dot matrix printer comprising the combination of a reciprocable hammer bank disposed along a printing line position and having a plurality of hammers, each of which includes a dot printing element for imprinting a dot when the hammer is actuated, a separate driving arrangement associated with each hammer for actuating the associated hammer when driven, means for periodically providing data denoting individual hammers to be actuated substantially simultaneously and means responsive to the data for driving the driving arrangement associated with each hammer to be actuated as denoted by the data, means responsive to each providing of data denoting individual hammers to be actuated substantially simultaneously for determining the number of hammers to be actuated, and the means for driving including means responsive to the means for determining the number of hammers to be actuated for varying the duration of driving of each driving arrangement associated with each hammer to be actuated in substantially direct proportion to the number of hammers to be actuated.

2. The invention set forth in claim 1, wherein each driving arrangement includes a drive amplifier coupled to the associated hammer and a latch coupled to energize the drive amplifier when set and to stop energizing the drive amplifier when cleared and the means for varying the duration of driving is operative to vary the time interval between the setting and clearing of each latch associated with a hammer to be actuated in direct proportion to the number of hammers to be actuated.

3. The invention set forth in claim 2, wherein the means for varying the duration of driving includes a counter, means for presetting the counter to a preset value representing a minimum time interval between the setting and clearing of each latch, and means for changing the preset value in the counter in response to the number of hammers to be actuated.

4. A hammer bank arrangement for use in a printer comprising the combination of a hammer bank having a plurality of hammers mounted along the length thereof, means for normally holding the hammers in a retracted position and including magnetic components common to all of the hammers, a different coil coupled in magnetic relation with each of the hammers and operative to release the hammer from the retracted position when energized, means for receiving data denoting each of the hammers to be released and means responsive to the data for energizing the coil in magnetic relation with each hammer denoted by the data to be released, the means for energizing including means responsive to the data for varying the energization of those coils to be energized in accordance with the total number of the hammers to be released as denoted by the data, the means for energizing the coil in magnetic relation with each hammer denoted by the data to be released including a different driver amplifier coupled to each coil, a different latch coupled to each driver amplifier and a shift register having a plurality of different stages with each stage being coupled to a different one of the latches, the shift register being coupled to receive the data, and wherein the means for varying the energization of those coils to be energized includes means for setting selected ones of the latches in accordance with the data received by the shift register and means for clearing all of the latches a selected period of time after setting selected ones of the latches, the selected period of time being directly proportional to the total number of the hammers to be released as denoted by the data.

5. The invention set forth in claim 4, wherein the means for varying the energization of those coils to be energized includes a counter, means for presetting the counter to a selected count, means responsive to receipt of the data by the shift register for counting the counter down in accordance with the number of hammers to be released as denoted by the data and means for causing the counter to begin counting upon the setting of the selected ones of the latches, and wherein the means for clearing all of the latches is operative to clear the latches when the counter begins to overflow.

6. An arrangement for energizing a plurality of hammer release coils in an impact printer comprising the combination of a plurality of hammer drivers, each adapted to be coupled to a hammer release coil, a plurality of latches, each of which is coupled to a different one of the hammer drivers, a shift register having a plurality of different stages, each of which is coupled to a different one of the latches, a counter, means for presetting the counter to a selected count value, means for providing serial data to the shift register, the serial data containing indications of hammer release coils to be energized, means responsive to the providing of serial data to the shift register for incrementing the counter in a first direction from the selected count value in accordance with the number of indications of hammer release coils to be energized contained in the serial data, means for setting each latch which is coupled to a stage of the shift register containing an indication of a hammer release coil to be energized, means responsive to the setting of each latch for incrementing the counter in a second direction opposite the first direction, the means for clearing the latches when the counter reaches a predetermined count.

7. The invention set forth in claim 6, wherein the means for incrementing the counter in a first direction includes means for providing a shift clock signal to the shift register and an AND circuit having an output coupled to the counter and a pair of inputs, one of the pair of inputs being coupled to receive the serial data provided to the shift register and the other one of the pair of inputs being coupled to receive the shift clock signal, and the means for incrementing the counter in a second direction includes a second AND circuit having an output coupled to the counter and a pair of inputs, means providing a clock signal to one of the pair of inputs of the second AND circuit and means providing a signal to the other one of the pair of inputs of the second AND circuit when serial data is not being provided to the shift register.

8. A hammer bank arrangement for use in a dot matrix printer comprising an elongated hammer bank structure, a plurality of elongated, flat, relatively thin hammer springs mounted in generally parallel, spaced-apart relation at a first end thereof along the elongated hammer bank structure, a plurality of impact printing tips, each mounted on a different one of the hammer springs adjacent the second end thereof, a common magnet member mounted on the elongated hammer bank structure in magnetic communication with the first end of each of the hammer springs, a permanent magnet mounted on the elongated hammer bank structure in magnetic communication with the common magnetic member, a plurality of magnetic pole pieces mounted in spaced-apart relation along the common magnetic member and each extending into contact with the second end of a different one of the hammer springs, a plurality of coils, each of which is disposed about a different one of the magnetic pole pieces, a plurality of coil energizing circuits, each coupled to a different one of the coils and operative to energize the coil while the circuit is turned on, means responsive to input data for turning on selected ones of the coil energizing circuits as denoted by the input data and means responsive to the input data for maintaining the selected ones of the coil energizing circuits turned on for a period of time determined by the total number of coil energizing circuits to be turned on as denoted by the input data, the input data comprising a succession of signals indicating coil energizing circuits to be turned on and the means for maintaining the selected ones of the coil energizing circuits turned on including means for counting the signals in the input data indicating coil energizing circuits to be turned on and means for maintaining the coil energizing circuits turned on for a period of time directly proportional to the number of signals in the input data indicating coil energizing circuits to be turned on which are counted.

* * * * *